US005144858A

United States Patent [19]

Funk

[11] Patent Number: 5,144,858

[45] Date of Patent: Sep. 8, 1992

[54] DEVICE FOR LIMITING ROTARY MOVEMENT

[75] Inventor: Helmut Funk, Remshalden-Grunbach, Fed. Rep. of Germany

[73] Assignee: Eastman Kodak Company, Rochester, N.Y.

[21] Appl. No.: 724,396

[22] Filed: Jun. 27, 1991

[30] Foreign Application Priority Data

Sep. 22, 1990 [DE] Fed. Rep. of Germany ..... 4030026

[51] Int. Cl.[5] ..... G05G 1/04

[52] U.S. Cl. ..... 74/526; 251/288; 192/139

[58] Field of Search ..... 74/526, 527, 528; 454/224, 278, 325, 335; 192/139; 251/286, 288

[56] References Cited

U.S. PATENT DOCUMENTS

| | | | |
|---|---|---|---|
| 63,748 | 4/1867 | Regester | 251/288 |
| 1,532,251 | 4/1925 | Lorraine | 251/286 |
| 1,940,130 | 12/1933 | Howell | 192/139 |
| 2,383,054 | 8/1945 | Franck | 251/286 |
| 2,468,281 | 4/1949 | Wildern | 251/286 |
| 4,645,042 | 2/1987 | Inoue et al. | 74/526 X |

*Primary Examiner*—Richard Lorence
*Assistant Examiner*—Khoi Q. Ta
*Attorney, Agent, or Firm*—Lawrence P. Kessler

[57] ABSTRACT

A device for limiting rotary movement in two directions comprising a housing (18) having a wall (17). A first stationary component (10) is attached to the wall (17) of the housing (18), the first stationary component having an arcuate segment (11) defined by lateral surfaces (11*a*, 11*b*) limiting the arc length thereof. A shaft (14) is rotatably mounted in the first component (10). A second component (20), also having an arcuate segment (21) defined by lateral surfaces (21*a*, 21*b*) limiting the arc length therof, is attached to the shaft. The first and second components (10, 20), respectively, have the same shapes and sizes and each of them is provided with a bearing (12, 22) which defines a bore (12*a*, 22*a*) and is molded on the arcuate segment (11, 21). Pins (11*c*, 21*c*) are positioned, respectively, to extend from oppositely directed faces of the arcuate segments (11, 21). The lateral surfaces (11*a*, 11*b*; 21*a*, 21*b*) of the first and second components (10,20) form abutments acting on both sides.

5 Claims, 2 Drawing Sheets

DEVICE FOR LIMITING ROTARY MOVEMENT

BACKGROUND OF THE INVENTION

This invention relates to a device for limiting rotary movement in two directions.

It is well known for a plate which serves, for example, as a bearing for a shaft to be provided with a bent-off portion. An element of the shaft, which extends beyond the bearing bore comprises a cam which, upon rotation of the shaft, abuts the bent-off portion in one direction or the other. It is difficult to coordinate the two lateral surfaces of the bent-off lug, which serve as abutments, and the cam of the shaft such that a rotary movement can be produced which has a predetermined angle of rotation.

SUMMARY OF THE INVENTION

It is the purpose of this invention to eliminate the disadvantage mentioned above and to create by simple means a device intended for mass production which is able to carry out a limited rotary movement in two directions, where no coordination measures have to be taken, and which forms at the same time a bearing for a shaft or the like.

In accordance with the invention, the device for limiting rotary movement comprises a housing (18) having a wall (17). A first stationary component (10) is attached to the wall (17) of the housing (18), the first stationary component having an arcuate segment (11) defined by lateral surfaces (11*a*, 11*b*) limiting the arc length thereof. A shaft (14) is rotatably mounted in the first component (10). A second component (20), also having an arcuate segment (21) defined by lateral surfaces (21*a*, 21*b*) limiting the arc length thereof, is attached to the shaft. The first and second components (10, 20), respectively, have the same shapes and sizes and each of them is provided with a bearing (12, 22) which defines a bore (12*a*, 22*a*) and is molded on the arcuate segment (11, 21). Pins (11*c*, 21*c*) are positioned, respectively, to extend from oppositely directed faces of the arcuate segments (11, 21). The lateral surfaces (11*a*, 11*b*; 21*a*, 21*b*) of the first and second components (10, 20) form abutments acting on both sides.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

Figure 1:
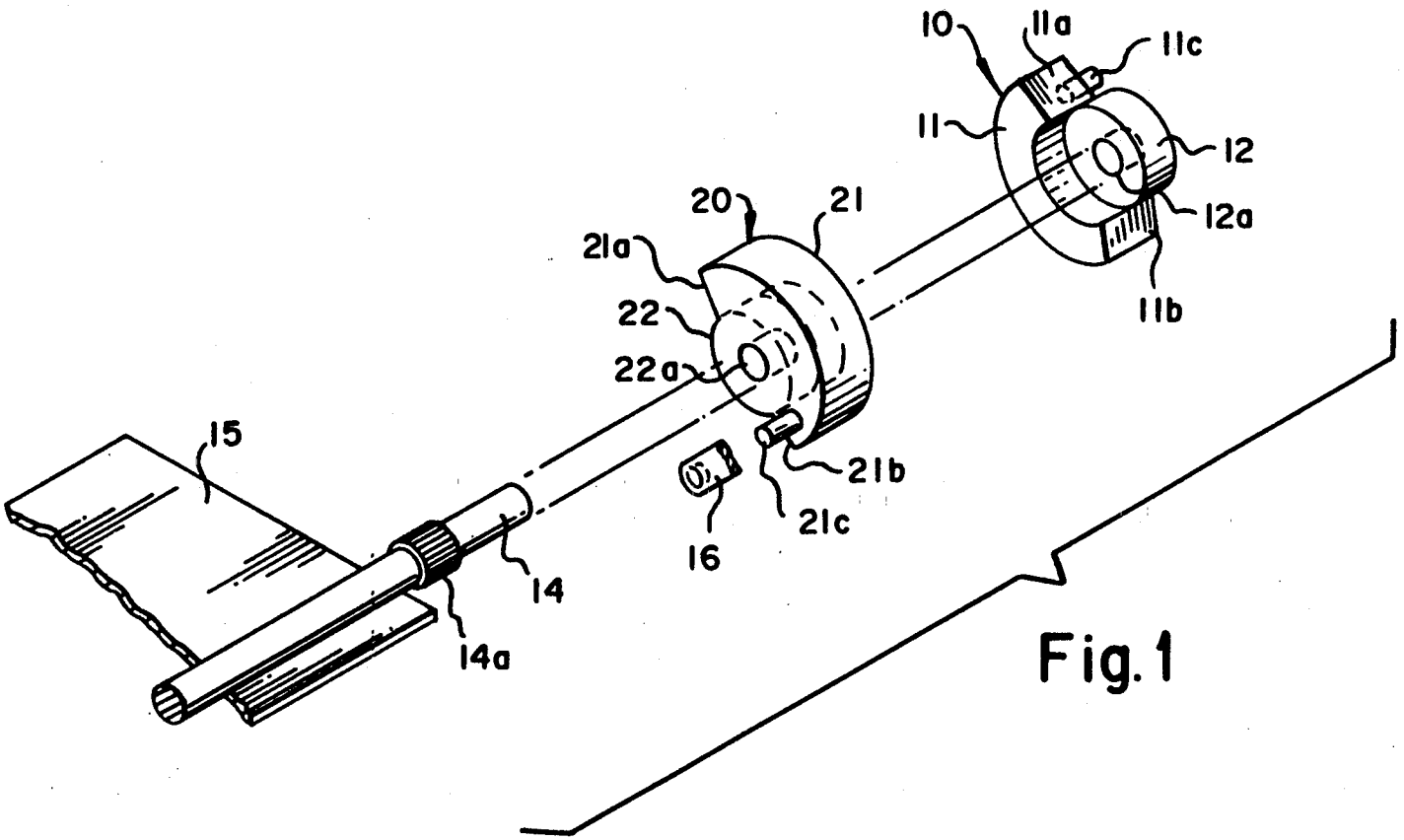
FIG. 1 is a diagrammatic view of the device for limiting rotary movement according to the invention.
Figure 2:
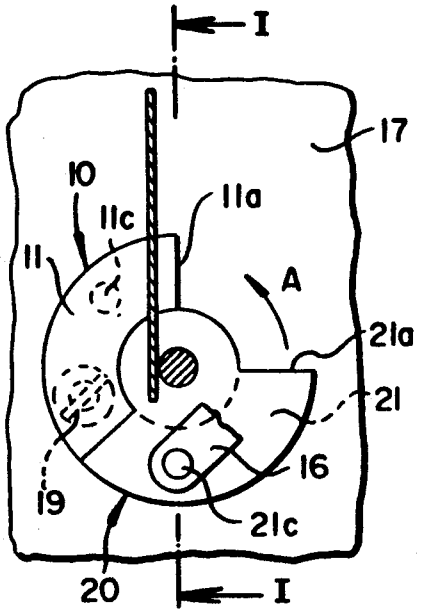
FIGS. 2 and 3 show the device for limiting rotary movement according to FIG. 1 in a fist and in a second operative position.
Figure 3:
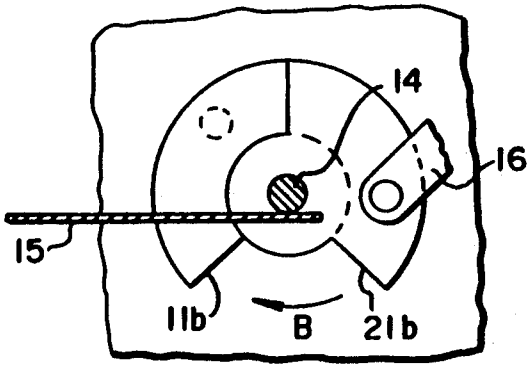

As can be seen from FIGS. 1—3, two components 10 and 20 are provided which have identical shapes and sizes and serve for limiting the pivotal movement of a plate which could be a baffle 15, a deflector, an air flap or the like. The two components are each provided with an arcuate segment 11 and 21, respectively, whose lateral surfaces limiting the arc lengths have the reference numerals 11*a* and 11*b*, and 21*a* and 21*b*, respectively. Each of the two components has a bearing 12 and 22, respectively, comprising a bore 12*a* and 22*a*, respectively, and being molded on the arcuate segment 11 and 21, respectively, as well as a pin 11*c* and 21*c*, respectively, positioned in the area of the rear end of each arcuate segment. Seen in the axial direction, the arcuate segments 11 and 21 have twice the length of the bearings 12 and 22 and form projecting steps on each of said bearings.

Figure 4:
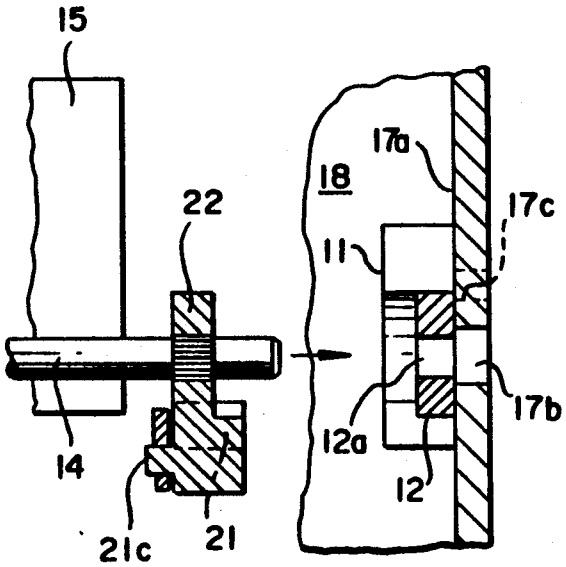
FIG. 4 is a sectional view of the subject matter of the invention along line I—I in FIG. 2.

As can be seen from FIGS. 2 and 4, a wall 17 of a housing 18 is provided with two bores 17*b* and 17*c*. The first component 10 is attached to the housing wall 17 by means of a screw 19 and arranged such that pin 11*c* engages with bore 17*c* in order that the component 10 be fixed in its proper position, and that bore 12*a* of bearing 12 aligned with the slightly bigger bore 17*b* in wall 17. The arcuate segment 11 projecting from the bearing 12 extends into the inner space of housing 18 in the form of a step.

The second component 20 is firmly pressed onto the knurling 14*a* of a shaft 14 by means of a bore 22*a* (FIG 1) of its bearing 22, with the step formed by the arcuate segment 21 pointing in the axial direction toward the first component 10. As can be seen from FIG. 4, the end of the shaft extends beyond the bearing 22 and is plugged into the bore 12*a* of bearing 12 of the first component 10 and is rotatably mounted therein. The two bearings 12 and 22 of components 10 and 20 are then aligned and in sliding contact with each other, the arcuate segment 21 which projects from the bearing 22 of the second component 20 in the form of a step being positioned in the plane of the arcuate segment 11 of the first component 10. As has been described, a baffle 15 is arranged on the shaft 14.

A pinion or lever 16 connected with the pin 21*c* of the second component 20 can be actuated manually or by a motor in order to move the second component 20 in the direction of the arrows "A" or "B", the shaft being rotatable in two directions and the baffle 15 thus also being pivotable in two directions. In this connection, the lateral surfaces 11*c* and 11*b*, and 21*c* and 21*b*, respectively, which limit the arc lengths of the arcuate segments 11 and 21, respectively, form abutments acting on both sides.

I claim:

1. Device for limiting rotary movement in two directions, said device comprising:

a housing (18) having a wall (17), a first stationary component (10), attached to said wall (17) of said housing (18), said first stationary component having an arcuate segment (11) defined by lateral surfaces (11*a*, 11*b*) limiting the arc length thereof, a shaft (14) rotatably mounted in said first component (10), a second component (20) also having an arcuate segment (21) defined by lateral surfaces (21*a*, 21*b*) limiting the arc length thereof, said second compartment attached to said shaft, said first and second components (10, 20), respectively, having the same shapes and sizes and each of them provided with a bearing (12, 22) which defines a bore (12*a*, 22*a*) and is molded on the arcuate segment (11, 21), and pins (11*c*, 21*c*) positioned, respectively, to extend from oppositely directed faces of said arcuate segments (11, 21), said lateral surfaces (11*a*, 11*b*; 21*a*, 21*b*) of said first and second components (10, 20) forming abutments acting on both sides.

2. Device according to claim 1, wherein, measured in the axial direction of said shaft, said arcuate segments (11, 21) have a length twice the length of said bearings (12, 22) and form projecting steps on each of said bearings.

3. Device according to claim 1, wherein a bore (17*c*) is provided in the housing wall (17), said first component (10) being attached to said housing wall (17) such that said pin (11*c*) associated therewith engages with said bore (17*c*) in order that said first component (10) is fixed in its proper position, and that said arcuate segment (11) projecting as a step from said bearing (12) and extending from the housing wall said housing (18).

4. Device according to claim 3, wherein second component (20) is firmly seated on said shaft (14) by means of its bearing (22), the end of said shaft projecting beyond said bearing (22) plugged into said bearing (12) of said first component (10) and rotatable therein, said bearings (12, 22) of both components (10, 20) aligned and in sliding contact with each other, and said arcuate segment (21) which projects from said bearing (22) of said second component (20) as a step and positioned in the plane of said arcuate segment (11) of said first component (10).

5. Device according to claim 1, wherein said pin (21*c*) of said second component (20) is connected with a motor-driven pinion (16).

* * * * *